US009211562B2

(12) United States Patent
Boehm et al.

(10) Patent No.: US 9,211,562 B2
(45) Date of Patent: Dec. 15, 2015

(54) DEVICE AND METHOD FOR MELTING AND SPRAYING THERMOPLASTICS

(71) Applicants: Kenneth Lee Boehm, Indianapolis, IN (US); Ivan Hess, Indianapolis, IN (US)

(72) Inventors: Kenneth Lee Boehm, Indianapolis, IN (US); Ivan Hess, Indianapolis, IN (US)

( * ) Notice: Subject to any disclaimer, the term of this patent is extended or adjusted under 35 U.S.C. 154(b) by 154 days.

(21) Appl. No.: 13/936,403

(22) Filed: Jul. 8, 2013

(65) Prior Publication Data

US 2014/0010964 A1 Jan. 9, 2014

Related U.S. Application Data

(60) Provisional application No. 61/669,218, filed on Jul. 9, 2012.

(51) Int. Cl.

| | |
|---|---|
| ***B05D 1/02*** | (2006.01) |
| ***B05C 5/00*** | (2006.01) |
| ***B05B 9/00*** | (2006.01) |
| ***B05B 9/01*** | (2006.01) |
| ***B05B 9/04*** | (2006.01) |

(52) U.S. Cl.

CPC ..... *B05C 5/001* (2013.01); *B05B 9/002* (2013.01); *B05B 9/007* (2013.01); *B05B 9/01* (2013.01); *B05B 9/0403* (2013.01); *B05D 1/02* (2013.01)

(58) Field of Classification Search

CPC ..... B05B 9/002; B05B 9/007; B05B 9/01; B05B 9/0403; B05C 5/001; B05D 1/02

USPC ..... 427/345; 118/602

See application file for complete search history.

(56) References Cited

U.S. PATENT DOCUMENTS

| | | | | |
|---|---|---|---|---|
| 2,522,652 | A * | 9/1950 | Von Haase | 219/214 |
| 3,637,111 | A * | 1/1972 | McCreary | 222/146.2 |
| 6,823,653 | B1 * | 11/2004 | Stark et al. | 53/560 |
| 7,124,806 | B1 * | 10/2006 | Wang et al. | 165/80.3 |
| 2004/0094986 | A1 * | 5/2004 | Landvik et al. | 296/70 |
| 2005/0132610 | A1 * | 6/2005 | Foxen et al. | 36/29 |

* cited by examiner

*Primary Examiner* — Alexander Weddle

(74) *Attorney, Agent, or Firm* — Carla Gannon Law

(57) ABSTRACT

A single-phase portable device melts and sprays thermoplastic using 120-V power. The device includes a vessel for receiving and storing thermoplastic, and heated hollow rod circulators that draw melted thermoplastic upward and redistribute it within the vessel to facilitate rapid and even melting. The device includes a heated hose and nozzle for spraying the material, hose storage area, and wheels and handle for moving device and spraying in multiple locations as desired.

17 Claims, 7 Drawing Sheets

DEVICE AND METHOD FOR MELTING AND SPRAYING THERMOPLASTICS

RELATED APPLICATIONS

This application claims the benefit of U.S. Provisional Patent Application 61/669,218, filed Jul. 9, 2012.

BACKGROUND OF THE INVENTION

1. Field of the Invention

The present invention relates to thermoplastic handling devices and methods of using them, and more specifically, to a portable device and method of heating thermoplastic materials and subsequently spraying them.

2. Description of the Prior Art

Thermoplastic coatings are often used in various mechanisms and machine parts in order to keep the system in good working order. For example, bearings on conveyor belts in the mining industry are often coated with thermoplastic. An example of such a thermoplastic is ENVIROPEEL E170 from A&E Systems of Malaysia.

The conventional system of accomplishing this is to heat the thermoplastic in a static tank having a heated bottom, relying on all heat to transfer upwardly from the bottom. Melted thermoplastic is then sprayed using a 230V 3-phase system. One example of such a system is the sprayer available through the aforementioned A&E Systems of Malaysia. However, this system has shortcomings. For one, the conventional system requires 230V, which is not always readily available. In addition, it requires at least two hours to achieve full tank melt because the melting vessel is, in essence, a large high-temperature slow-cooker. In addition, the system is large and cumbersome, and therefore is not reasonably moved from one location to another. This is problematic because it isn't always feasible to remove mechanical parts, bring them to a sprayer to be coated, then reinstall those coated parts afterwards.

As can be seen, there is a need for a self-contained device for heating and spraying thermoplastics. It is desirable that this system is capable of running off a standard 120 V source, and is single phase. It is also desirable that the system is capable of melting thermoplastic relatively quickly, and relatively energy efficiently. It is also desirable that this system is portable insofar as it can be used in one location; unplugged, replugged, transported and used in another location; and so forth.

SUMMARY OF THE INVENTION

The present invention includes a portable device for use with thermoplastic materials. The device includes a vessel for receiving solid-form thermoplastic, a series of heaters and fluid circulators, and a hose and nozzle for spraying melted thermoplastic. The system also includes a control panel for selecting desired operating parameters such as temperature, circulation speed, pressure for spraying, and so forth.

One novel feature of the present invention is hollow rod heaters which use a valve assembly and pump to draw melted thermoplastic from the vessel, transfer it upward through the heated hollow tube, and discharge it from the top of the hollow tube. This action facilitates even melting by moving material throughout vessel and constantly circulating material past heaters, and by allowing melted material to mix with solid-form material, thereby facilitating ongoing even heat transfer. The result is a system that uses about half the energy, and half the time, to bring a given mass of solid-state material to the melted state for spraying.

The device also desirably includes a heated hose and a nozzle for spraying the melted material, as well as the associated compressor, tank and pump. The device includes a storage compartment sized to retain the hose when not in use. A set of wheels and a handle assist in moving the device from one location to another as desired. In this manner, one batch of solid-form thermoplastic may be melted, and the device can be moved to multiple locations, for example within a mining operation, to spray various parts with thermoplastic.

DETAILED DESCRIPTION OF THE PREFERRED EMBODIMENTS

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The following structure numbers apply among the various FIGS:

10—Sprayer device ("device");
12—Wheels;
14—Handle;
20—Drive motor;
30—Vessel;
32—Hollow rod;
34—Solid rod;
40—Hose storage;
45—Hose;
47—Nozzle;
50—Compressor;
52—Tank;
60—Recirculation valve assembly;
65—Pump; and
70—Control panel.

Figure 1:
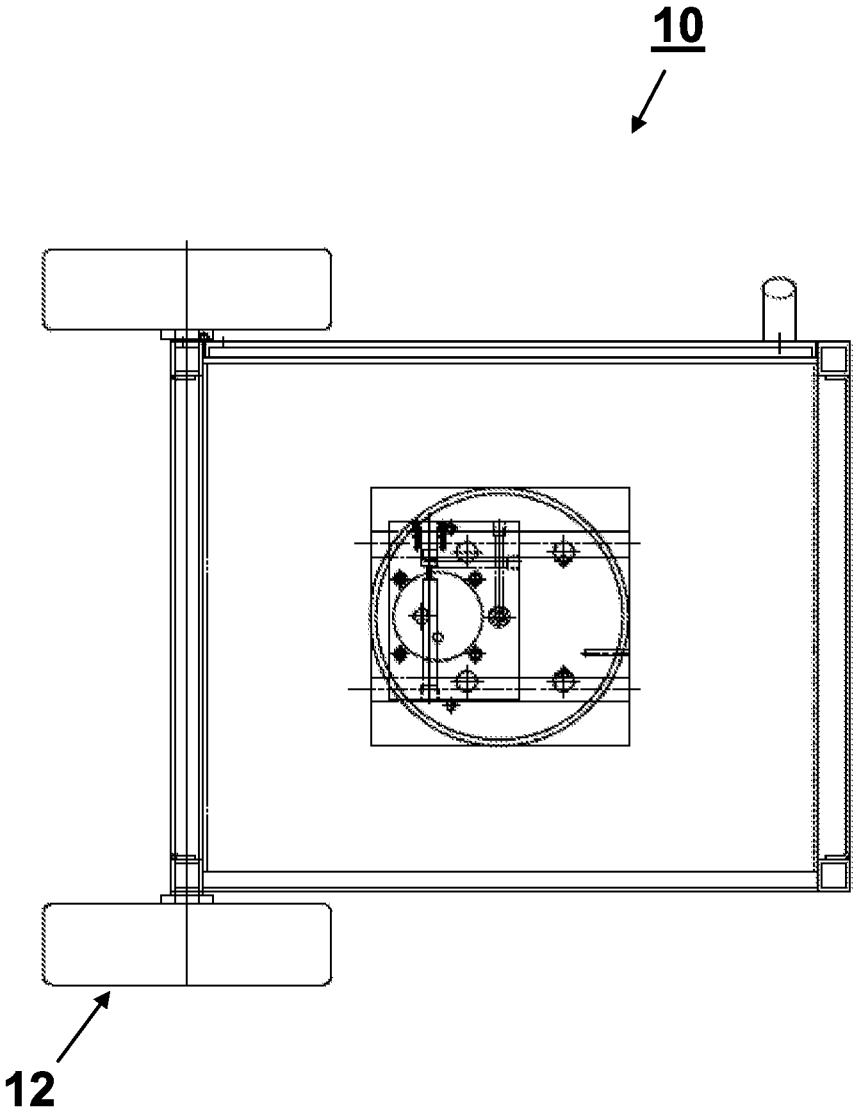
FIG. 1 is a top view of a device according to an embodiment of the present invention, without a lid and motor assembly.
Figure 2:
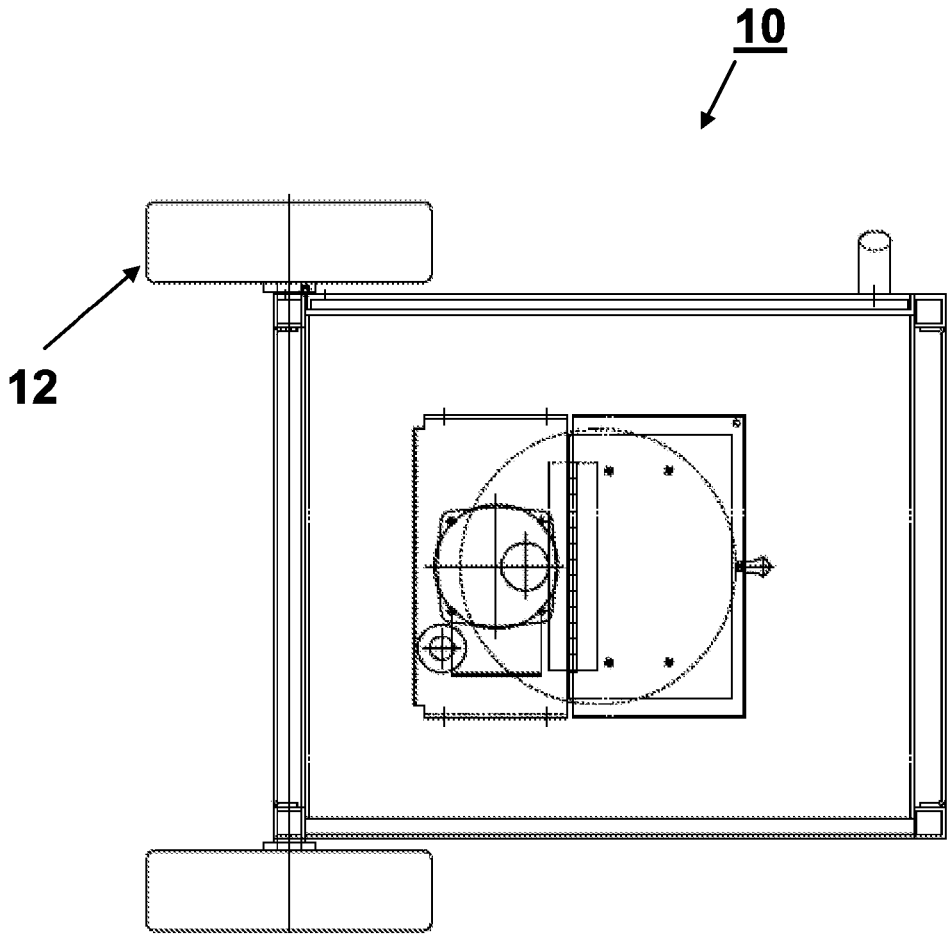
FIG. 2 also depicts a top view, except with a lid and motor assembly.
Figure 3:
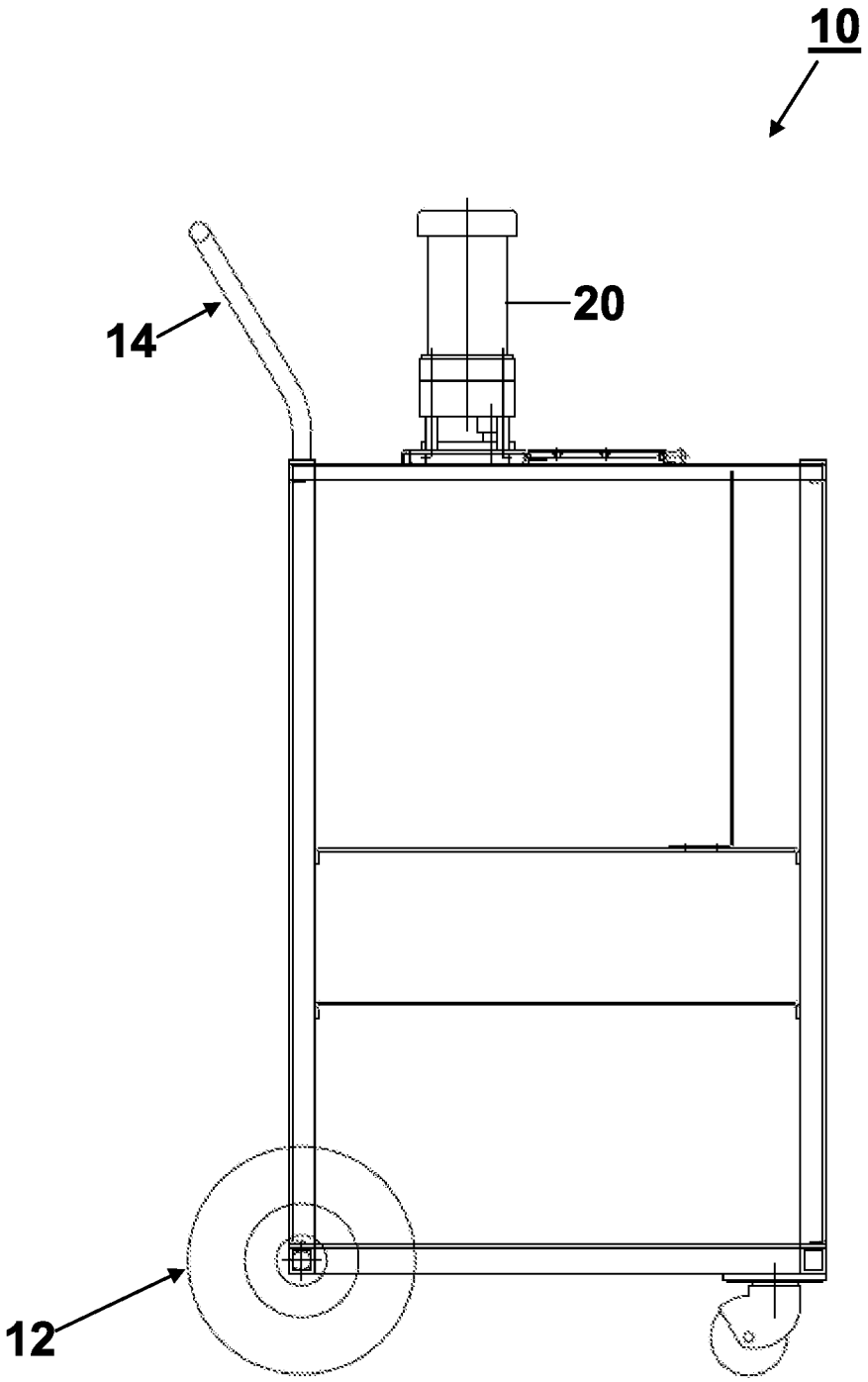
FIG. 3 is a side view of the invention.

Broadly, an embodiment of the present invention provides a portable device 10 including heating and spraying functionality. FIGS. 1 and 2 depict top views of an embodiment of device 10, including wheels 12. In use, one tilts device 10, with handle 14, and rolls using wheels 12. This is best depicted in FIG. 3. The device is single phase, and connects to a 110 V electrical source using a standard connection such as a cord.

Figure 4:
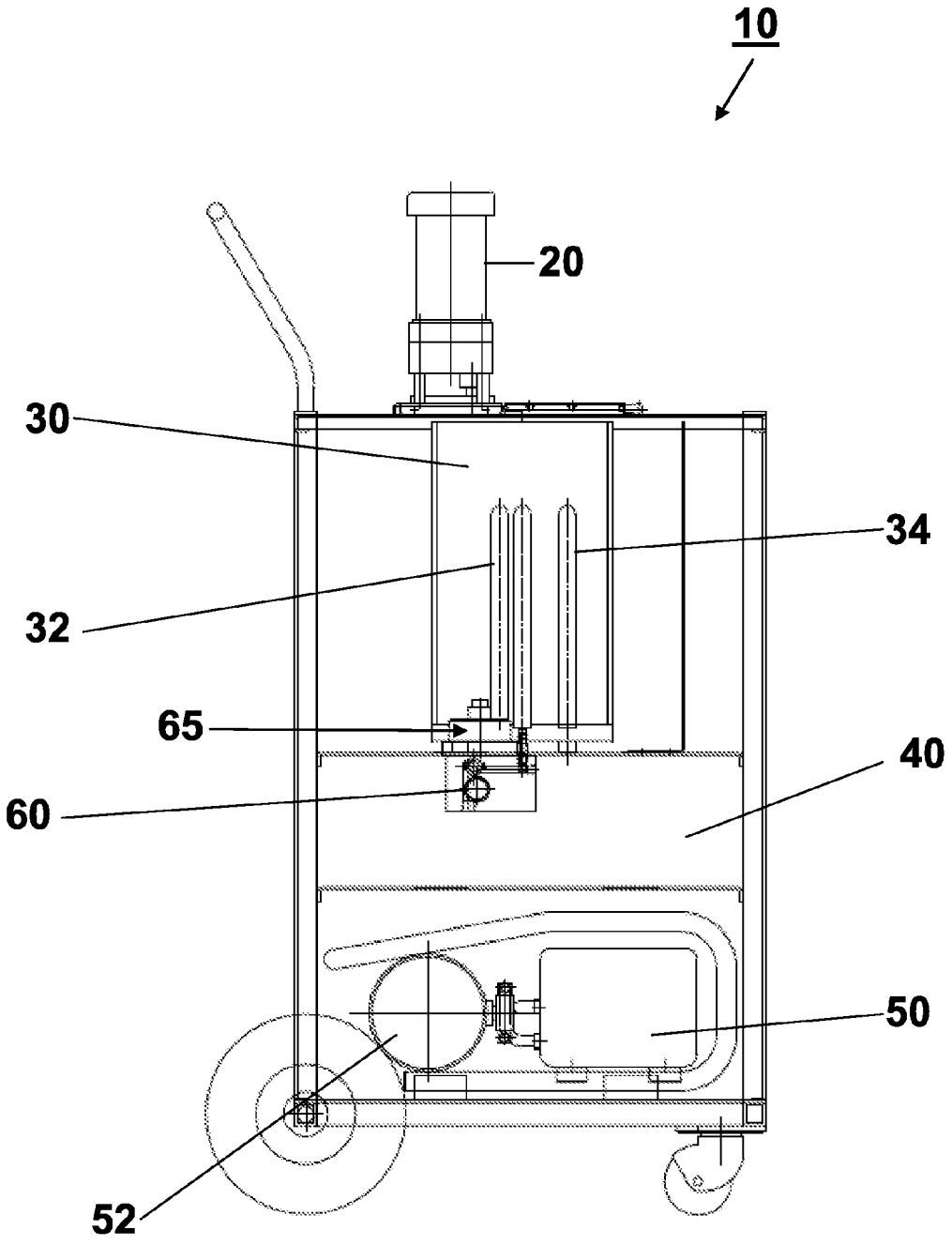
FIG. 4 is a side view showing the inner components.

Device 10 includes various components. Referring to FIG. 4, going generally from top to bottom, device 10 includes drive motor 20, which is electromechanically connected to pump 65 and recirculation valve assembly 60. The drive motor preferably has an AC induction motor having a torque of 56 lb. and horsepower of 0.06. An example of a suitable drive motor is the Leeson D12B gear motor, which is commercially available from Grainger, Inc. of Indianapolis, Ind.

Vessel 30 includes hollow rod 32 and solid rods 34, all of which are heating elements configured to melt thermoplastic placed inside vessel 30. Vessel 30 preferably has a capacity of approximately 20 to 30 pounds of thermoplastic. Rods can be heated to various temperatures, typically in the range of 300° F. to 375° F., with 330° F. to 340° F. being preferred, depending on the characteristics of the specific thermoplastic. However, heating 75° F. to 450° F. is also within the scope of this invention. Once the desired temperature is met, melted thermoplastic is continuously pumped with pump 65 through recirculation valve assembly 60 through hollow rod 32. This process transports melted thermoplastic from the bottom of vessel 30, up through the insides of hollow rod 32, where it comes out the top, thereby heating thermoplastic located in the upper portion of vessel 30. This expedites the melting process by evenly distributing the heat throughout vessel 30 via the melted thermoplastic. This can be conceptualized as a heated thermoplastic fountain of sorts. Solid rods 34 heat the thermoplastic, but don't provide a longitudinal path through which melted thermoplastic may travel, as the hollow rods do. As the thermoplastic is uniformly melted, it moves more easily through hollow rod 32. Rods 32 and 34 maintain uniformity of melted thermoplastic while in device 10. The result is that thermoplastic is ready for use in approximately 1 hour, versus 2 hours for conventional systems. In addition, thermoplastic is ready for use with approximately 50% less energy than is required by conventional systems.

Device 10 also includes spraying capability. More specifically, hose storage 40 contains heated delivery hose and application head connected to recirculation valve assembly 60. Recirculation valve assembly 60 is connected to pump 65. It is preferred that heated hose is approximately 12 feet long, and has a diameter of approximately 1". An example of a suitable delivery hose is Dynaflex from ITW Dynatec of Hendersonville, Tenn. Tank 52 is attached to a separate air line inside of heated delivery hose and delivers pressurized air to assist in certain application methods.

Figure 5:
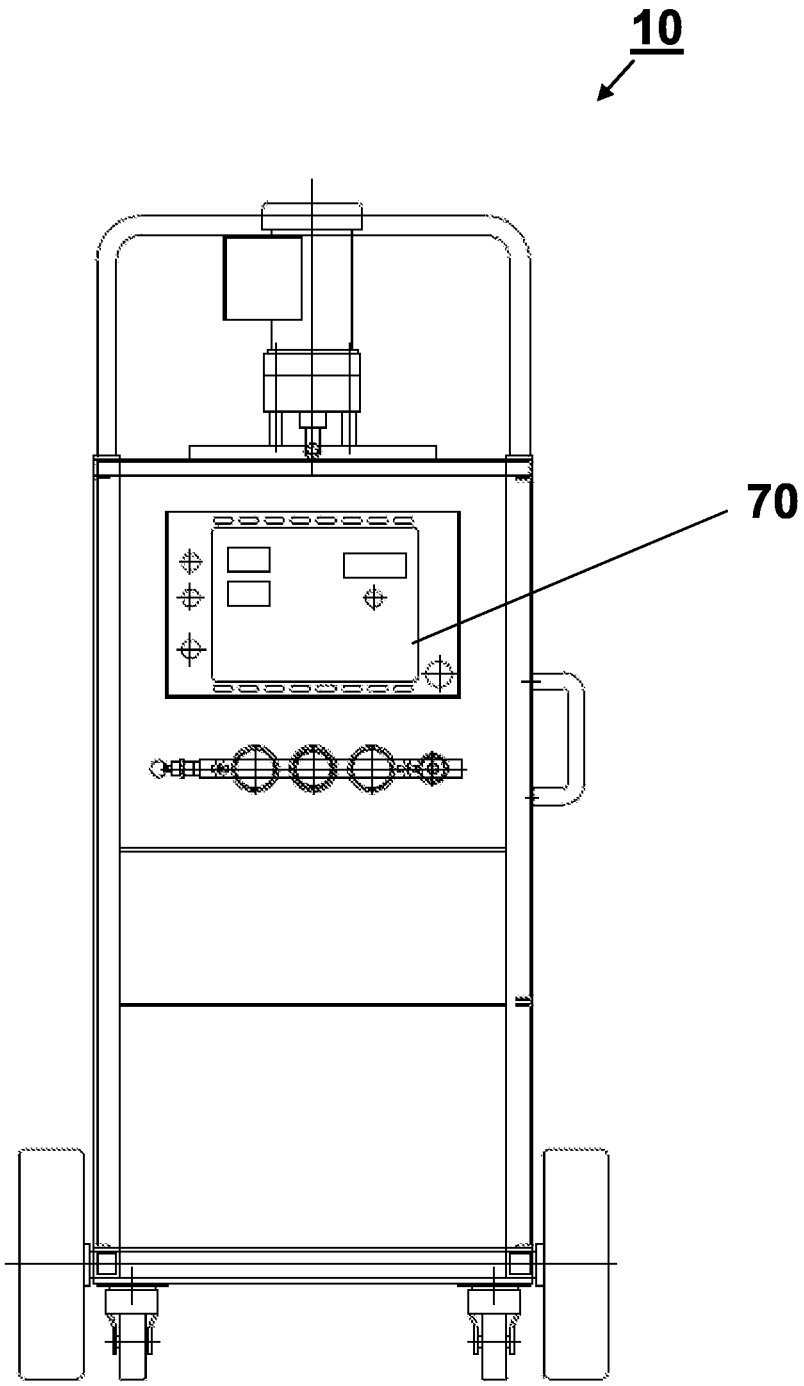
FIG. 5 is a front view

As shown in FIG. 5, functions are controlled by control panel 70, which contains main power switch, drive motor control and compressor controls, and through which an operator sets parameters such as melting temperature, and spray force. Control panel 70 may also serve as a display insofar as it displays actual system temperature and heating sequences, when thermoplastic is uniformly melted, and when power switch is on.

Figure 6:
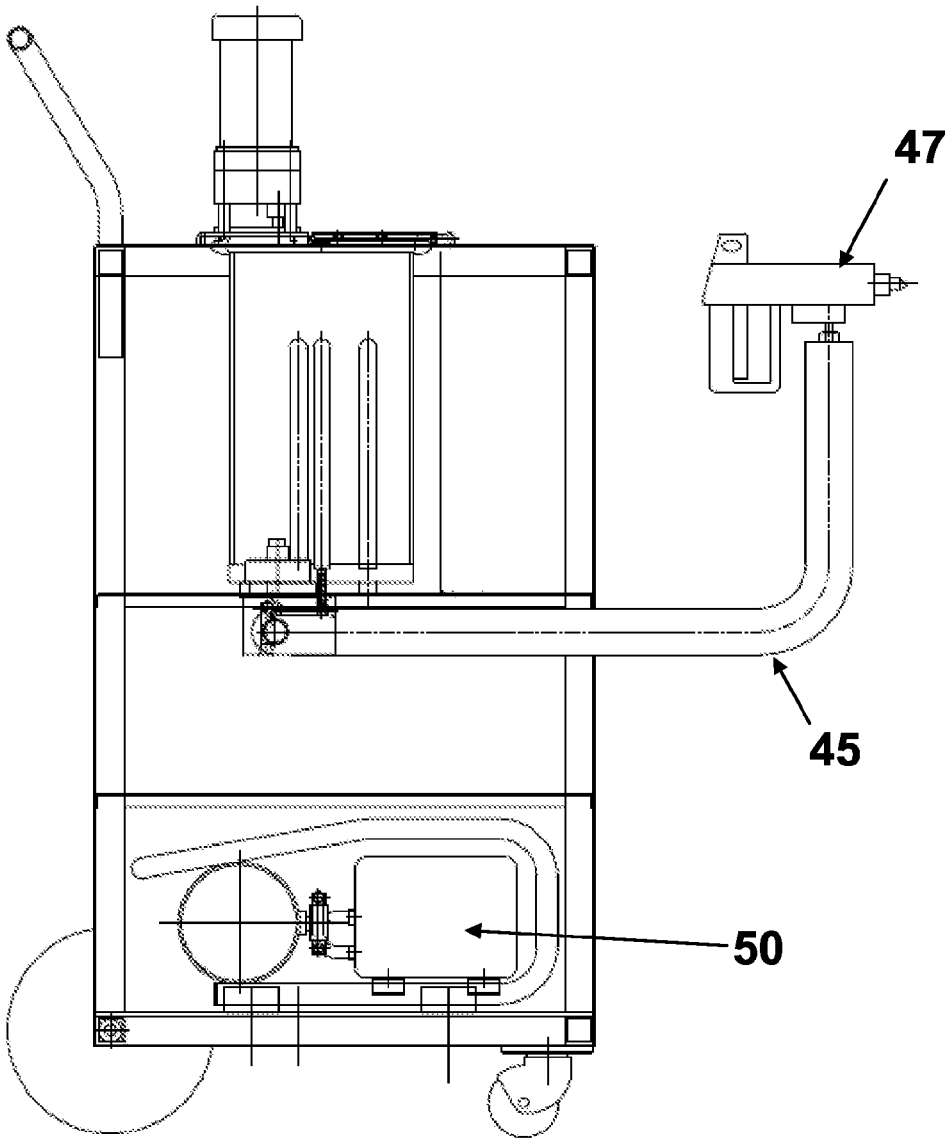
FIG. 6 is a side view including a hose and nozzle.
Figure 7:
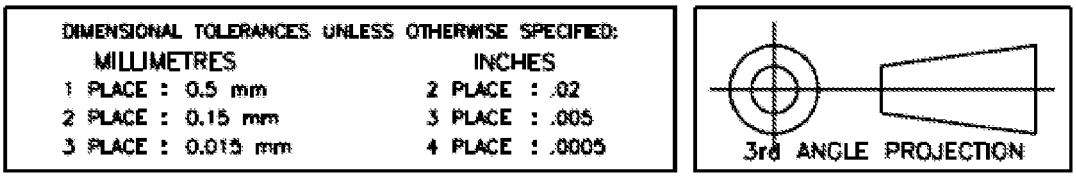
FIG. 7 includes some engineering parameters.

In use, an operator puts a quantity of solid-form sprayable thermoplastic material into vessel 30, enters proper settings into control panel 70, and allows device 10 adequate time for uniform melting to occur. Referring to FIG. 6, once thermoplastic is ready, hose 45 is taken from hose storage 40, attached to valve 60, and compressor 50 is turned on. Although not shown, compressor 50 is in fluid communication with the hose and nozzle. The user then coats the desired parts by spraying them using nozzle 47, in accordance with standard procedures. When coating is complete, device 10 is rolled to the next location for subsequent spraying of those desired parts. Once all coating is complete, device 10 is shut down and cleaned.

It should be understood, of course, that the foregoing relates to exemplary embodiments of the invention and that modifications may be made without departing from the spirit and scope of the invention as set forth in the following claims. It should also be understood that ranges of values set forth inherently include those values, as well as all increments between.

What is claimed is:

1. A self-contained device for portably heating and spraying thermoplastic coatings, said device including:

a. A vessel for maintaining thermoplastic material;

b. A hollow heating rod positioned completely within said vessel, said hollow heating rod including an inlet, an outlet, and a non-diverted unitary channel there between; and c. A drive motor electromechanically connected to said hollow heating rod for transporting said thermoplastic upwardly through said channel of said hollow heating rod, wherein said upwardly transported thermoplastic exits said channel through said outlet only.

2. The self-contained device of claim 1 further including a 120V compatible electrical connection.

3. The self-contained device of claim 2 wherein said hollow heating rod provides heat in the 300° F. to 375° F. range.

4. The self-contained device of claim 2 further including a solid rod for heating, said rod not configured to transport said thermoplastic upwardly.

5. The self-contained device of claim 4 further comprising a recirculation valve assembly electromechanically connected to said drive motor.

6. The self-contained device of claim 5 further comprising a heated hose connected to said recirculation valve assembly.

7. A method of preparing thermoplastic for use including the steps of:

a. Inserting solid-form sprayable thermoplastic material into a vessel, said vessel including a bottom region and a top region;

b. Heating a hollow rod within said vessel, said hollow rod defining an inlet positioned within said bottom region, an outlet positioned within said top region, and a non-diverted unitary channel there between;

c. Allowing said thermoplastic to melt;

d. Transporting melted thermoplastic upwardly from said inlet, through said channel, to said outlet of said hollow rod, wherein said upwardly transported thermoplastic exits said channel through said outlet only; and e. Allowing said melted thermoplastic to exit said outlet and return to said vessel.

8. The method of claim 7 further including the step of repeating steps c-e until all thermoplastic is melted.

9. The method of claim 7 further including the step of selecting a heating temperature for said hollow rod using a control panel.

10. The method of claim 7 wherein said step of allowing said melted thermoplastic to return to said vessel includes the step of allowing said melted thermoplastic to heat said solid-form thermoplastic.

11. The method of claim 7 wherein said step of transporting melted thermoplastic upwardly includes the preliminary step of turning on a pump to effectuate said transportation.

12. A method of portably spraying thermoplastic including the steps of:

a. Rolling a sprayer device to a desired location;

b. Electrically connecting said sprayer device to a 120 V electrical source;

c. Inserting solid-form thermoplastic into a vessel of said sprayer device;

d. Heating said solid-form thermoplastic;

e. Transporting melted thermoplastic upwardly through a heated hollow rod having a non-diverted unitary channel, said heated hollow rod located completely within said vessel;

f. Expelling transported melted thermoplastic from said heated hollow;

g. Allowing expelled thermoplastic to return to said vessel;

h. Moving melted thermoplastic in said vessel through a hose; and i. Expelling melted thermoplastic through a nozzle.

13. The method of claim 12 wherein said step of inserting solid-form thermoplastic into a vessel includes the step of inserting 20-30 pounds of solid-form thermoplastic into said vessel.

14. The method of claim 12 wherein said step of heating said solid-form thermoplastic includes the step of heating said solid-form thermoplastic to a temperature of 330° F. to 340° F.

15. The method of claim 12 wherein said step of expelling transported melted thermoplastic from said heated hollow rod includes the step of expelling transported melted thermoplastic solely from a single outlet of said heated hollow rod.

16. The method of claim 12 wherein said step of allowing expelled thermoplastic to return to said vessel includes the step of allowing said melted thermoplastic to comingle with unmelted thermoplastic.

17. The method of claim 12 wherein said step of moving melted thermoplastic through a hose includes the step of pumping.

* * * * *